US008866399B2

(12) United States Patent
Adamowicz

(10) Patent No.: US 8,866,399 B2
(45) Date of Patent: Oct. 21, 2014

(54) METHOD FOR CONTROLLING HIGH INTENSITY DISCHARGE LAMP AND SUPPLY SYSTEM FOR HIGH INTENSITY DISCHARGE LAMP

(75) Inventor: Piotr Adamowicz, Sopot (PL)

(73) Assignee: AZO Digital SP. Z.O.O., Gdansk (PL)

( * ) Notice: Subject to any disclaimer, the term of this patent is extended or adjusted under 35 U.S.C. 154(b) by 75 days.

(21) Appl. No.: 13/386,535

(22) PCT Filed: Dec. 6, 2010

(86) PCT No.: PCT/PL2010/000121

§ 371 (c)(1),
(2), (4) Date: Jan. 23, 2012

(87) PCT Pub. No.: WO2011/071398

PCT Pub. Date: Jun. 16, 2011

(65) Prior Publication Data

US 2012/0119666 A1 May 17, 2012

(30) Foreign Application Priority Data

Dec. 10, 2009 (PL) ..... 389856

(51) Int. Cl.
*H05B 41/36* (2006.01)
*H05B 41/292* (2006.01)

(52) U.S. Cl.
CPC ..... *H05B 41/2928* (2013.01)
USPC ..... 315/224; 315/291

(58) Field of Classification Search
CPC ..... H05B 41/042; H05B 41/2928
See application file for complete search history.

(56) References Cited

U.S. PATENT DOCUMENTS 4,373,146 A * 2/1983 Bonazoli et al. ..... 315/209 R
5,677,602 A * 10/1997 Paul et al. ..... 315/224
5,923,128 A * 7/1999 Canova ..... 315/291
6,147,463 A * 11/2000 Luger et al. ..... 315/307

(Continued)

FOREIGN PATENT DOCUMENTS

HU E 000951 11/2003
WO 96/38024 11/1996
WO 03/017736 2/2003
WO 03/024161 3/2003

OTHER PUBLICATIONS

International Search Report for PCT/PL2010/000121 dated Jun. 1, 2011.

(Continued)

*Primary Examiner* — Alexander H Taningco
*Assistant Examiner* — Nelson Correa
(74) *Attorney, Agent, or Firm* — K&L Gates LLP

(57) ABSTRACT

Methods and apparatus for controlling a high intensity discharge lamp and a power supply system for the high intensity discharge lamp are disclosed. The system relates to a method for controlling high intensity discharge lamp comprising supplying a signal of variable frequency and constant filling factor from a switches cascade to a ballast circuit and the lamp, said ballast circuit having at least one condenser and at least one inductance. The method uses the signal of periodically fluctuating frequency and constant filling factor of 50%, supplied from the electronic switches cascade of the half-bridge type, connected with the ballast circuit and the lamp, where the ballast circuit includes at least first condenser, the lamp and includes first inductance and second condenser forming a resonant circuit. A supply system for high intensity discharge lamp is also disclosed.

36 Claims, 7 Drawing Sheets

(56) References Cited

U.S. PATENT DOCUMENTS

| | | | | |
|---|---|---|---|---|
| 6,177,768 | B1 * | 1/2001 | Kamata et al. | 315/241 R |
| 6,411,044 | B2 * | 6/2002 | Wessels et al. | 315/244 |
| 6,870,324 | B2 * | 3/2005 | Shen | 315/223 |
| 6,975,077 | B2 * | 12/2005 | Izumi et al. | 315/209 R |
| 7,019,468 | B2 * | 3/2006 | Deurloo et al. | 315/291 |
| 7,084,584 | B2 * | 8/2006 | Ben-Yaakov | 315/291 |
| 8,294,390 | B2 * | 10/2012 | Samejima et al. | 315/326 |
| 2002/0145393 | A1 | 10/2002 | Hui et al. | |

OTHER PUBLICATIONS

High Intensity Discharge Lamps, Technical information on reducing the voltage, OSRAM. Feb. 2009.
Hungarian Search Report dated Sep. 3, 2012.

* cited by examiner

METHOD FOR CONTROLLING HIGH INTENSITY DISCHARGE LAMP AND SUPPLY SYSTEM FOR HIGH INTENSITY DISCHARGE LAMP

CROSS REFERENCES TO RELATED APPLICATIONS

The present application is a National Stage of International Application No. PCT/PL2010/000121 filed on Dec. 6, 2010, which claims priority to Polish Patent Application No. P-389856, filed on Dec. 10, 2009, the entire contents of which are being incorporated herein by reference.

TECHNICAL FIELD

The present disclosure relates in general to high intensity discharge lamps, and, in particular, to methods and apparatus for controlling a high intensity discharge lamp and a power supply system for the high intensity discharge lamp.

BACKGROUND

Thanks to high efficiency, ranging from 100 to 150 lm/W, high intensity discharge lamps are widely used in urban and large-format lighting systems. In typical ignition and supply systems of high intensity discharge lamps, there are an inductive ballast (BALLAST) and a starter, which generates a high voltage on this ballast until a moment of lamp ignition. After an ignition, ballast's inductance limits a flow of current through a lamp. In order to reduce degradation of electrodes, a square wave supply voltage is most often used for supplying high intensity discharge lamps with limiting inductance (BALLAST).

A typical system for supplying discharge lamps from AC mains is composed of a diode rectifier and a power factor correction system (PFC), which are an internal source of stabilized voltage of about 400V. This voltage supplies a cascade system of electronic switches (transistors), FULL or HALF BRIDGE types, which being controlled by a proper control system is a source of alternating voltage of set value, at which the value of serial inductance limits the current running through a lamp to the set value. Circuits with regulated frequency are complemented a condenser being parallel to a lamp and serial to an inductance, to obtain a serial resonant circuit. Generating an alternating voltage of a frequency close to self resonant frequency of this circuit in the switches cascade induces a high alternate voltage in a condenser of said circuit. This voltage is used to initiate an ignition of discharge lamps.

The document "High Intensity Discharge lamps—Technical information on reducing the wattage", published by the OSRAM company in February 2009, discusses methods of reducing and regulating of a power supplied to discharge lamps. In typical solutions, the only element stabilizing a power supplied to a lamp is an inductance whereas a power regulation, at set current stability and mains frequency, is done by selecting an inductance for predicted power. Such solution is sensitive to changes of mains parameters and in practice, it forces constructing a separate supply network for urban lighting systems.

Supplying high intensity discharge lamps using frequencies over 1 kHz causes forming of acoustic waves, which in a wide frequency range of supply courses (from 1 kHz to 1 MHz) result in an appearance of acoustic resonance. This phenomenon destabilizes a flow of current through plasma causing an instability of discharging arc, lamp blinking and in extreme cases even mechanical damage of a burner. Typical methods of eliminating this effect consist in supplying high intensity lamps with voltages of two courses—the main one of a frequency range in which the resonance can occur, and the second one of higher frequency which stabilizes the discharging arc. European patent specification EP 1327382 discloses the method of supplying discharge lamp, in which in order to reduce an adverse acoustic resonance, a frequency modulation (FM) and pulse width modulation (PWM) of square-wave voltage supplying the ballast are used, what results in an additional amplitude modulation (AM) of supplying wave.

SUMMARY

The system relates to the method for controlling high intensity discharge lamp comprising supplying a signal of variable frequency and constant filling factor from the switches cascade to the ballast circuit and the lamp, said ballast circuit having included at least one condenser and at least one inductance. In the method it is used the signal of periodically fluctuating frequency and constant filling factor of 50%, supplied from the electronic switches cascade of the half-bridge type, connected with the ballast circuit and the lamp, where the ballast circuit includes at least first condenser, the lamp and includes first inductance and second condenser forming a resonant circuit.

The system is also related to the supply system for high intensity discharge lamp comprising the stabilized voltage source, which supplies the electronic switches cascade, half or full bridge type, connected with the lamp and the ballast, which ballast includes at least one condenser and at least one inductance, and includes the generator of the signal of voltage or current regulated frequency and the generator control unit for generating modulated width impulses. The system is characterized in that it includes the signal generator of voltage or current regulated frequency and constant filling factor and the control unit comprising at least one signal generator of constant frequency and variable filling factor. The control unit output is connected with the control input of the signal generator in such way that the control system is adapted to deliver to the signal generator impulses of modulated width, which change the signal generator operating frequency, and where the signal generator is connected with the electronic switches cascade of half-bridge type, and the ballast includes first condenser, first inductance, second condenser, and it includes second inductance separating the lamp from second condenser.

DETAILED DESCRIPTION OF EXEMPLARY EMBODIMENTS

Figure 1:
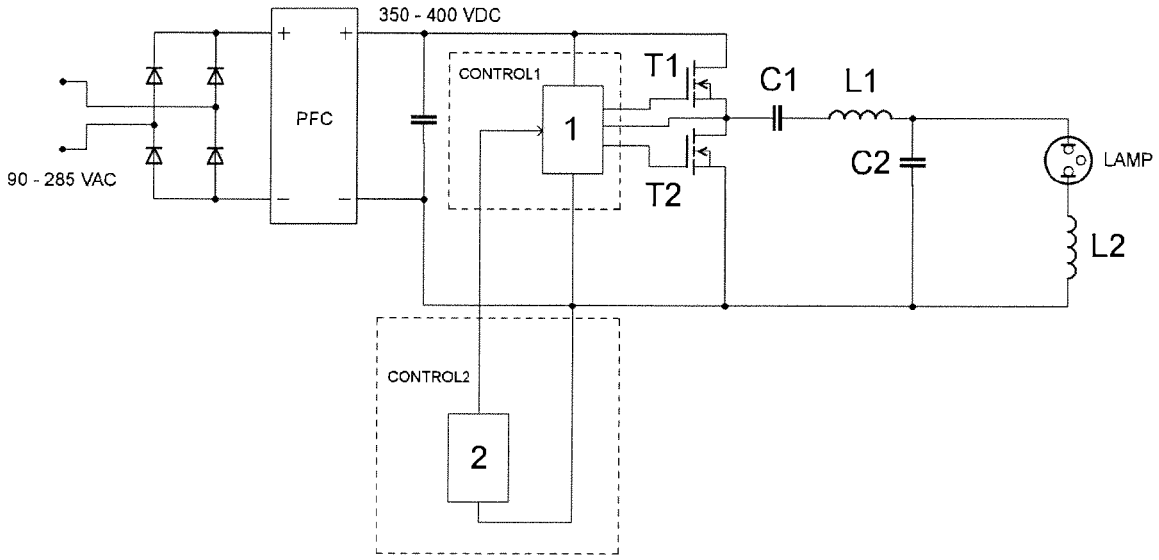
FIG. 1 is an example circuit diagram of the topology.

The presently disclosed system solves these problems. According to the discussed solutions, a regulation of power supplied to a lamp includes measurements of current and voltage on lamp electrodes and a change of parameters of supplying voltage wave, e.g. changing a voltage amplitude, changing a frequency or changing its filling factor.

For inducing an ignition of high intensity discharge lamp, it is necessary to generate a high voltage from 2.5 kV to 15 kV. One of methods for generating the proper voltage is supplying the circuit having an inductance and including a condenser, said condenser being connected in series with the inductance and in parallel to the lamp, which condenser and inductance form a serial resonant circuit, with the current of frequency close to the free-running resonant frequency of the circuit. After reaching the ignition voltage, the ignition of lamp starts as the result of high voltage generation on the condenser being parallel to the lamp.

The international publication WO 2008/132662 discloses a use of ignition system in systems with limiting inductance and a FULL BRIDGE supply system employing one cascade of switches (transistors), for generating a high voltage at the moment of ignition on a condenser being parallel to a lamp, or for detection of a discharging arc decay in a lamp.

In the case of resonant serial ignition systems, effectiveness of obtaining high voltages on a resonant condenser depends on a capacity of said condenser. In practice, for the value range of current intensities being safe for a lamp system (up to 20 A), in order to gain voltages of the order of several or dozens of kilovolts on a resonate condenser, its capacity is limited to several nanofarads. On the other hand, the capacity of this condenser is directly related with the resonant frequency.

$$f = \frac{1}{2\pi\sqrt{LC}}$$

(where: f—resonant frequency, L—inductance, C—capacity)

The resonant frequency depends also on the value of limiting inductance L, which depends on the frequency and the voltage supplying the discharge lamp and on the expected power supplied to the lamp. Generally, in case of lamps of a power ranging from 30 to 400 W being supplied by over-acoustic courses, the value of inductance L ranges from several dozens of uH to several mH. In the consequence, the Q factor values obtained in these systems, being equal to:

$$Q = \frac{1}{R}\sqrt{\frac{L}{C}}$$

(Q—quality factor, R—substitute serial resistance of the system, L—inductance, C—capacity) are high and resonance curves are characterised by steep slopes, what results in a need of very precise selection of inducing frequencies for particular resonant ignition systems of discharge lamps. Due to the accepted tolerance of parameters of commercial products, diversification of actual values of inductance and capacity results in a spread of resonant frequencies of systems, what in turn forces implementation of techniques employing changes of supply voltage frequencies for generating a high voltage. Typically, for serial resonant ignition systems, the frequency supplying the resonant system is decreased, from the value higher than the resonant frequency of the system, through over-resonant frequencies being close to the resonant frequency at which an ignition should take place, and towards the operating frequency (the frequency at which the inductance limits the current to the value corresponding to the set power). As the inducing frequency is getting closer to the resonant frequency, in case of the lack of or damage of the lamp, sudden growth of the voltage and current takes place in the resonant circuit what can lead to the circuit damage or failure of other system elements. In practical arrangements of systems, said risk forces usage of protective systems.

The system disclosed provides an alternative method for controlling high intensity discharge lamp and a power supply system for high intensity discharge lamp.

A method for controlling high intensity discharge lamp comprising supplying a signal of variable frequency and constant filling factor from a switches cascade to a ballast circuit and a lamp, said ballast circuit having included at least one condenser and at least one inductance, is characterized in that, it is used the signal of periodically fluctuating frequency and constant filling factor of 50% supplied from the electronic switches cascade of the half-bridge type, connected with the ballast circuit and the lamp, where the ballast circuit includes at least first condenser, the lamp and includes first inductance and second condenser forming a resonant circuit. Preferably, the signal of periodically fluctuating frequency and constant filling factor of 50% is obtained from the signal generator by controlling a square signal of constant frequency and variable filling factor being generated by the control unit. Especially, the ballast includes second inductance separating the lamp from second condenser. In particular, between the stabilised voltage source and the cascade of electronic switches the value of supply current is measured, preferably by means of the measuring element, and on the basis of value obtained, the value of current between second condenser terminal and ground and the value of current between the second inductance terminal and ground are determined.

Preferably, in the ignition mode of high intensity discharge lamp, the signal of high voltage and periodically fluctuating frequency is supplied to the excitation of resonant circuit, said exciting signal being of the highest frequency lower from the sub-resonant frequency value, for which frequency the level of voltage generated on second condenser in the resonant circuit including first inductance and second condenser, is sufficient for the ignition of lamp. Particularly, in the ignition mode, during supplying the signal of periodically fluctuating frequency, the current value is measured between the condenser terminal and ground, preferably by means of the measuring element, the value of current set in comparator of comparators unit is compared, and when the current value exceeds the set value, the signal delivery is stopped. Optionally, in the ignition mode, during supplying the signal of periodically fluctuating frequency, the current value is measured between inductance terminal and ground, preferably by means of the measuring element, the value of current set in comparator of comparators unit is compared, and when the current value reaches the set value, the exciting signal delivery is stopped and the signal delivery in the lamp supply mode is started.

Preferably, in the supply mode of high intensity discharge lamp, it is used the frequency being modulated in cycles and smoothly, from the lowest value to the highest value and again from the highest to the lowest.

Preferably, the regulation of power supplied to the lamp is performed using the frequency changes by changes of the ratio of the time period, in which the frequency is increasing to the time period in which the frequency is decreasing.

In particular, the high intensity discharge lamp is the sodium lamp. For frequency changes, especially, at least one modulating frequency is used and the depth of modulation does not exceed 15%, and the ratio of the time period in which the frequency is increasing to the time period in which the frequency is decreasing ranges from 0.1 to 10. Preferably, the modulated frequency is 50 kHz, the modulating frequency is 240 Hz and the depth of modulation is 10%.

In particular, the high intensity discharge lamp is the metal halide lamp. For frequency changes, especially, at least one modulating frequency is used, and the depth of modulation does not exceed 20%, and the ratio of the time period in which the frequency is increasing to the time period in which the frequency is decreasing ranges from 0.1 to 10. Preferably, the modulated frequency is 130 kHz, the modulating frequency is 240 Hz and the depth of modulation is 10%. Preferably, the power supplied to the lamp is regulated by changing the filling factor of PWM course in the control unit. The change of filling ratio of PWM course in the control unit is performed using microchip control.

Preferably, the discharge arc decay is detected on the basis of current value between second inductance terminal and ground, especially when said value is much lower than the current value set on a comparator in comparators unit for the proper lamp operation, and then the lamp ignition mode is resumed. Preferably, the lack of lamp or its damage making its operation impossible is detected on the basis of the current value between second inductance terminal and ground, checking when said current value differs from the value set on the comparator in the comparators unit for the proper lamp ignition, especially after the ignition attempt performed after the time period being necessary for lamp cooling.

Preferably, after detecting the discharge arc decay and resuming lamp ignition, the power value being delivered to the lamp is decreased and if the arc is not decaying said power value is sustained, and in case or arc decay the ignition mode is resumed and the procedure of decreasing power is retried.

A supply system for high intensity discharge lamp comprising stabilized voltage source, which supplies an electronic switches cascade half or full bridge type connected with a lamp and a ballast, which ballast includes at least one condenser and at least one inductance, said system including a generator of signal of voltage or current regulated frequency and a generator control unit for generating modulated width impulses, is characterised in that said system includes the signal generator of voltage or current regulated frequency and constant filling factor and the control unit comprising at least one signal generator of constant frequency and variable filling factor, where the control unit output is connected with the control input of signal generator in such manner that the control system is adapted to deliver to the signal generator impulses of modulated width, which change the signal generator operating frequency, and where the signal generator is connected with the electronic switches cascade being of half-bridge type, and the ballast includes first condenser, first inductance, second condenser, and it includes second inductance separating the lamp from second condenser. Preferably, the ballast includes first condenser and first inductance on the input terminal of lamp and second condenser connected in parallel to the lamp, and it includes on the lamp output terminal second inductance separating the lamp from second condenser, where first inductance and second condenser are arranged in series to each other and form a part of the resonant circuit. In particular, the voltage signal generated on the switches cascade output is square and its filling factor is 50%. The system, especially, includes the measuring element between the stabilized voltage source and the electronic switches cascade, for the measurement of supplying current values. Optionally, the system includes the measuring element for the measurement of current running through the resonant circuit having included first inductance and second condenser. In particular, the system includes the measuring element for the measurement of current running through the lamp. Preferably, the measuring elements are the resistive measuring units. Optionally, the measuring elements are the inductive measuring units.

Preferably, the control unit includes the PWM generator and the comparators unit, which controls the PWM generator. In particular, the PWM generator is the microchip, having the PWM output, controlled by the comparators unit.

Preferably, the high intensity discharge lamp is the sodium lamp.

Optionally, the high intensity discharge lamp is the metal halide lamp.

The method for controlling high intensity discharge lamps and the supply system demonstrate many advantages, which predestine the subject solution for common use in practical embodiments of lighting systems. The system is characterised by high efficiency, higher from traditional electromagnetic solutions, and also is characterized by a simplicity of arrangement of the control and executive systems, in comparison to state of art electronic models. The method for controlling and the system arrangement provide safe functioning in the lamp ignition mode, as the risk of system damage resulting from excessive voltage or current is eliminated. Moreover, the control method provides automatic regulation of the lamp supply parameters, with the option to stabilize the consumed power at particular set level. Next, the method enables to regulate the power consumed by the lamp, with possibility to set an self-regulation level. Making use of the method and system provides longer period of a proper lamp exploitation, and due to the implemented adaptive algorithms, significant prolongation of lighting period of worn lamps.

Making use of the solution in lighting systems enables to obtain lighting without stroboscopic effect (in contrast to traditional solutions, where an effect of flickering occurs at the frequency twice higher than mains frequency, i.e. 100 Hz or 120 Hz).

Moreover, thanks to the implementation of power factor correction module PFC in the system, the elimination of passive power losses is achieved (since the power factor corresponds to cos $\phi$)=0.99), what leads to the reduction of resistance losses in wires and supply lines. The possibility of using of wide scope of input voltages and the high resistance to voltage changes enables to eliminate the need of establishing separate power networks for supplying the municipal lighting systems.

The supply system for high intensity discharge lamp, presented in FIG. 1, is supplied from an alternating current network and includes an internal stabilized voltage source, of about 400V, which typically includes a diode rectifier and a power factor correction system PFC. The stabilized voltage source is supplying the electronic switches cascade, such as HALF BRIDGE type, which includes transistors T1 and T2 serving as electronic keys. The switches cascade, as a result of controlling by signal generator CONTROL1, becomes a source of alternating current of a set value, for which the value of serial inductance LI limits current running through the lamp LAMP to a set level. The system is supplemented by the condenser C2 parallel to the lamp LAMP and serial to the inductance L1, to obtain a serial resonant circuit. Generating in the cascade of switches T1 and T2 alternating voltage of the frequency close to free-running resonant frequency of the circuit having included inductance LI and condenser C2, induces the occurrence of high alternating voltage on condenser C2, said voltage being used for inducing the discharge lamp LAMP ignition.

The signal generator CONTROL 1 includes the generator 1 of variable frequency being voltage or current controlled and constant filling factor (50/50%). The signal generator CONTROL1 is connected with the control unit CONTROL2, which includes the generator 2 of constant frequency and variable filling factor PWM for modifying the generator 1 frequency. The system includes additional inductance L2, which separates the lamp LAMP from the condenser C2. Surprisingly, introducing the additional inductance L2 and the control unit CONTROL 2 of the characteristics discussed below, provided the stabilisation of discharge lamp LAMP operation and the realisation of innovative control method, especially the method of ignition, supplying and regulating power of the high intensity discharge lamp.

Figure 2:
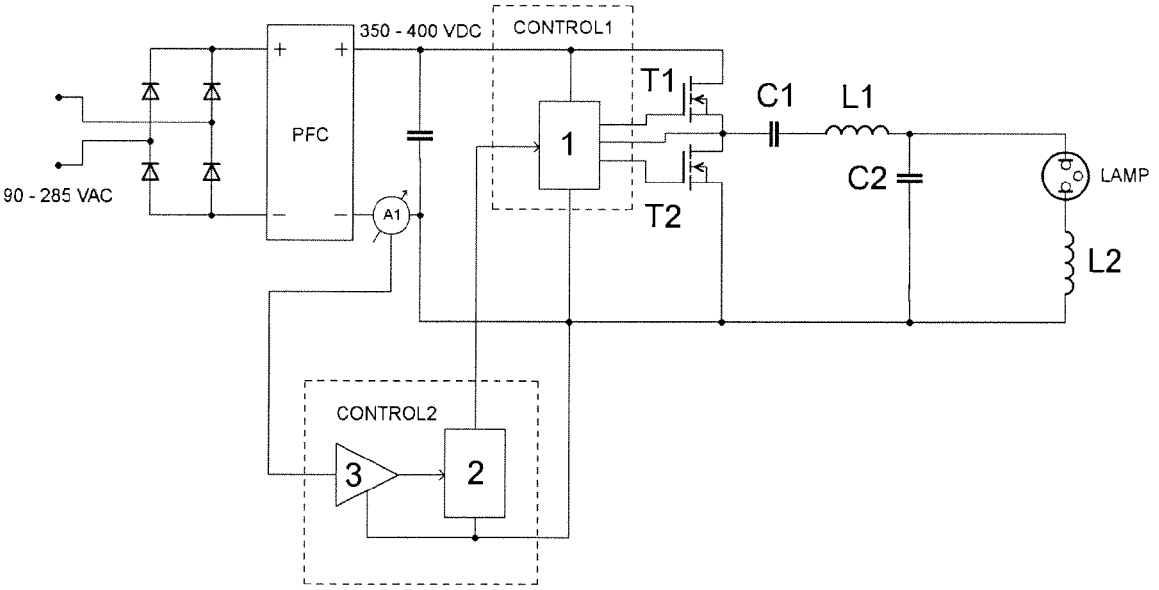
FIG. 2 is an example circuit diagram for dynamic power regulation.

FIG. 2 presents the preferred modification of the supply system for the high intensity discharge lamp, which is presented in the FIG. 1. This modification enables the control of lamp operation, in particular controlling the power consumed by the high intensity discharge lamp LAMP. The system according to FIG. 2 includes the measuring element A1, between PFC system and the cascade of electronic keys T1 and T2 and the rest of system. The measuring element AI serves for measuring the supply current value. The measuring element AI can be a resistive measuring unit or an inductive measuring unit.

The system according to FIG. 2 comprises the comparators unit 3 including at least one comparator, in the control unit CONTROL2. The comparators unit 3 is connected with the result output of the measuring element AI and analyses its state by comparing it with the set value, and the result of this comparing is used for modifying output parameters of the generator 2, what results in a change of output parameters of the signal generator CONTROL1, which controls the cascade of electronic keys T1, T2 and leads to the change of lamp LAMP operation parameters.

Figure 3:
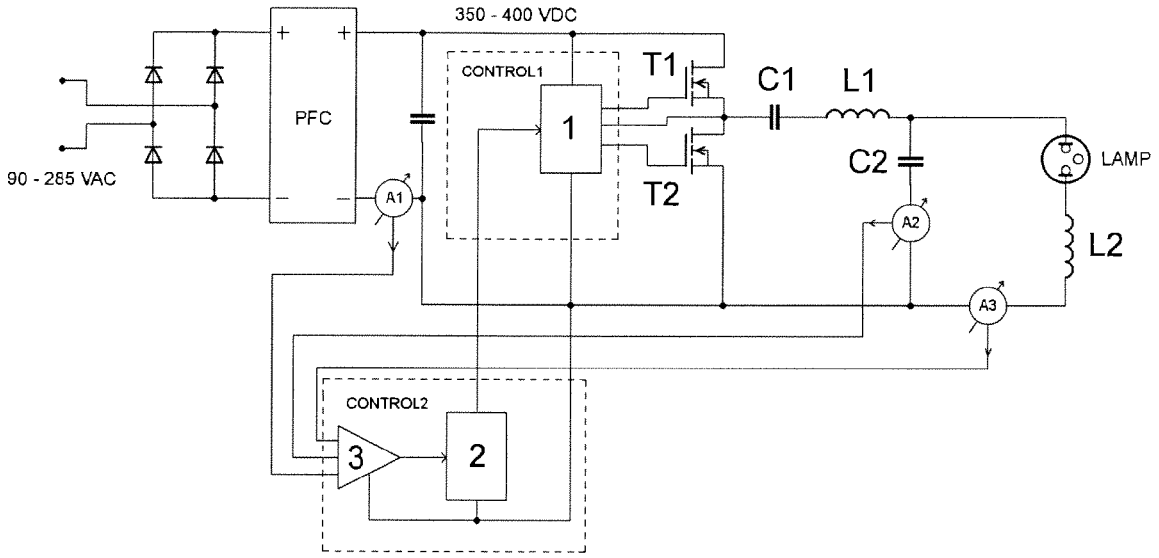
FIG. 3 is an example circuit diagram for dynamic power regulation and auxiliary measuring units.

FIG. 3 presents another modification of the system according to FIG. 2. The system of FIG. 3 includes additional measuring elements A2 and A3 and corresponding comparators in the comparators unit 3. The measuring elements A2 and A3 serve for measuring the current value. The measuring elements A2 and A3 can be resistive measuring units, inductive measuring units or combination thereof. On the basis of direct measurements of currents determined in the system points where the measuring elements A2 and A3 are placed, advanced measuring and control procedures are realised, both in the ignition mode and in the operation mode of the lamp. The measuring element A2, which is connected with the condenser C2 and with the negative pole of the supply, is designed for measurement of the current running through the condenser C2. The measuring element A3, which is connected with the inductance L2 and with the negative pole of the supply, is designed for measurement of the current running through the inductance L2.

The measured values of current, determined by the measuring elements A2, A3 or determined in the point of system where A2 or A3 are placed, are compared with set values in the comparators unit 3, and on the basis of such comparison output parameters of the generator 2 are modified, what leads to appropriate change on the output of the signal generator CONTROL1.

Surprisingly, the supply system enables realisation of the innovative method for the ignition of high intensity discharge lamp. So far used method of resonant ignition in supply-ignition systems for discharge lamps (for frequencies over 1 kHz, especially super-acoustic frequencies) consists in supplying the resonant circuit LI-C2 with an alternating voltage course of frequency higher than the resonant frequency of LI-C2 circuit. Next, the frequency is reduced to a value close to the resonant frequency, at which the voltage generated on the resonant condenser is sufficient for the lamp ignition. After the ignition, further reduction of frequency takes place, up to the value at which the limiting inductance LI limits current running through the lamp LAMP at set value. This method leads to unavoidable equalisation of the frequency with the resonant frequency, and in the case of lack of lamp or its damage it results in generating very high voltages on the resonant condenser at substantial values of current consumed by the supply system. As the high voltage and high current value may cause damage of the ignition system, it is necessary to use appropriate measuring-protective systems.

Figure 4:
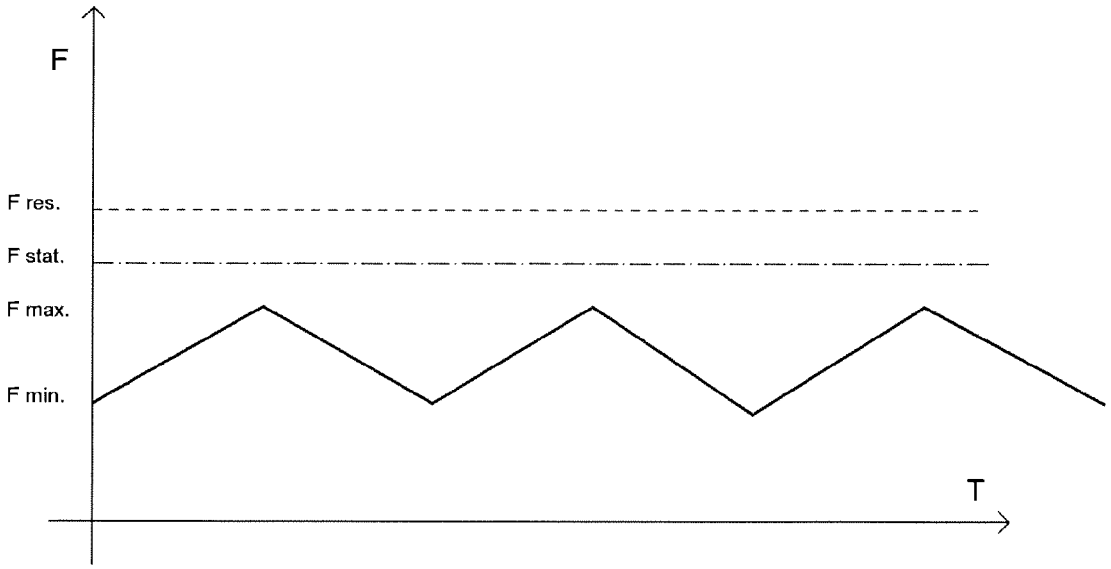
FIG. 4 is an example chart showing frequency changes versus time in the system functioning according to an ignition mode.

The method of resonant ignition comprises supplying the resonant circuit with the voltage of periodically fluctuating frequency. According to the method, the resonant circuit is supplied with the sub-resonant frequency, with the periodic frequency change. The chart of frequency variability during ignition is presented in FIG. 4. On the chart F represents the frequency axis, T represents the time axis, $R_{res.}$ represents the resonant frequency of circuit L1-C2, $F_{stat.}$ represents the constant frequency (at which the ignition takes place), $F_{max.}$ represents the maximal value of modulated frequency at dynamic ignition, and $F_{min.}$ represents the minimal value of modulated frequency at dynamic ignition. The serial resonant circuit including the inductance L1 and the condenser C2, is supplied with the alternating voltage course ranging from the lowest frequency $F_{min.}$ the highest frequency $F_{max.}$, with the periodic change of this frequency between these values. Both frequency $F_{min.}$ frequency $F_{max.}$ are frequencies lower not only from the resonant frequency $F_{res.}$, but also from $F_{stat.}$, i.e. constant frequency at which the ignition occurs.

It has to be stressed that surprisingly the value of frequency F. is always smaller than value $F_{stat}$. Due to the above, the current consumed by the resonant circuit is also lower than in a method according to the state of art using over-resonant frequencies.

Figure 5:
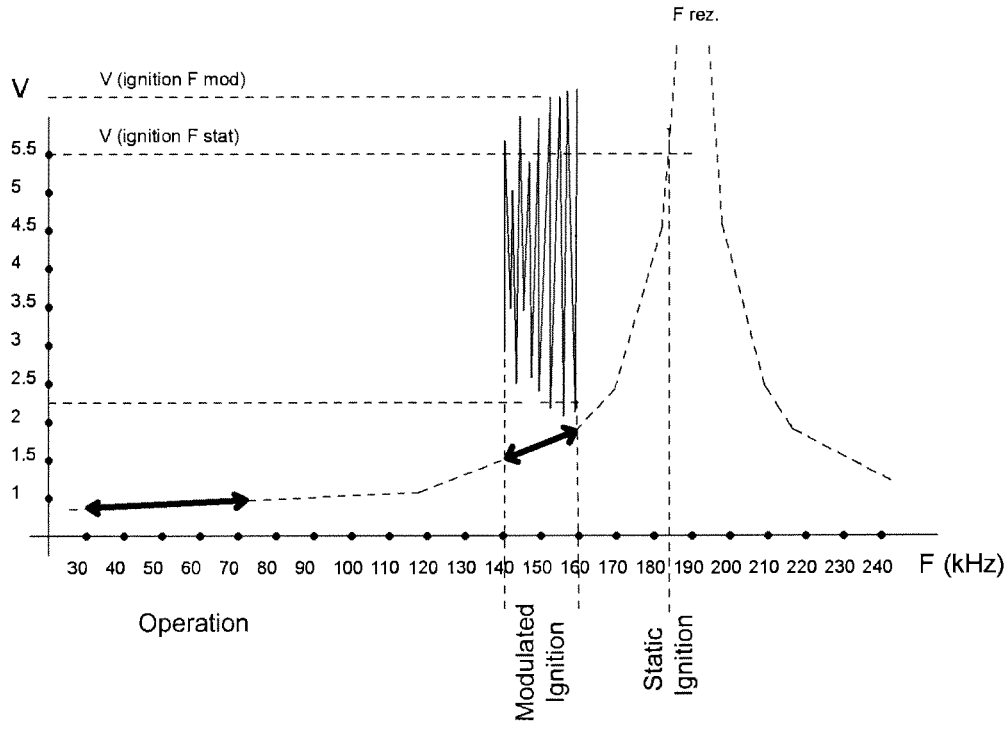
FIG. 5 is an example graph showing voltage changes in the system functioning according to the ignition mode.

The principle of the ignition method illustrated in FIG. 5, which presents graphs of voltages obtained in the ignition resonant system, at supplying this system with the voltage of constant frequency V(ignition $_{F\ stat.)}$ and the voltage of modulated frequency $V_{(}$ignition $_{F\ mod.)}$. On the graph the axis V represents the axis determining the ratio of condenser C2 voltage versus input voltage $V_{(C_2)}/V_i$n, the axis F (kHz) represents frequency axis, the scope Operation indicates the scope of frequency modulation at operation phase, the scope Modulated Ignition corresponds to the scope of frequency modulation during dynamic ignition, and Static Ignition represents the constant frequency at which the voltage on the condenser C2 is sufficient for the ignition. $_{Frcs.}$ represents the resonant frequency of LI-C2 circuit.

Surprisingly, experimental results show that the maximal frequency $_{Fmax.}$ can differ from the resonant frequency in such extend that the maximal current consumed by the ignition system during ignition would not exceed maximal acceptable values, despite a spread of resonant frequencies values of practical systems (resulting from the diversification of real inductance and capacity values of commercial products used in these systems). During experiments, the systems were subjected to testing in which the supply voltage of the cascade of transistors T1, T2 amounted to 395 V, and values of elements parameters and their tolerance amounted to, respectively, for condenser CI: 47 nF (±5%), for inductance LI: 600 41 (±10%), for condenser C2: 1,175 nF (±5%), for inductance L2: 25 41 (±10%). The resonant frequency value for the circuit including the inductance LI and the condenser C2 amounted to about 190 kHz. The frequency value was changed within the range from Fmin. 140 kHz to $_{Fmax.}$ 160 kHz, according to the principle defined in FIG. 4 and FIG. 5, with the frequency of 240 Hz and the equal time periods of increasing and decreasing this frequency value. During the experiments, ignition tests were run for high intensity sodium and metal halide discharge lamps, of power ranging from 70 W to 400 W, using the system according to FIG. 1, and initiating the ignition employing the innovative method of frequency modulation as in FIG. 4 and FIG. 5. The efficiency of ignition in the case of cool (of temperature below 50° C.) and warmed up sodium lamps amounted to 80% at 10 ms of the supply time of the resonant system with a modulated course. Extending this time to 30 ms resulted in the increase of the efficiency up to 100%, both in case of cool lamps and warmed to normal operating condition and cooled down at ambient temperature for 1 minute period. In the case of ignition of metal halide lamps, 100% ignition efficiency has been achieved for the modulation time being equal, respectively, to 50 ms. The re-ignition of lamp warmed up to the normal operating conditions required the cooling period amounting to 5 minutes.

During ignition the average power consumed by the cascade of transistors T1, T2 and the resonant circuit with the inductance L 1 and the condenser C2 did not exceed 50 W, whereas the instantaneous average values of current (time below 50 ns) did not exceed several amperes. These value proved to be safe for typical systems of the HALF and FULL BRIDGE type based on unipolar transistors, enabling to maintain the high voltage during the period sufficient for lamp ignition. In the case of lack of lamp in the housing, the current overload of these elements did not occur. Thus surprisingly the usage of method enables the elimination of necessity of using additional elements protecting the supply system against damages.

The phenomenon of acoustic resonance is an important difficulty related to the exploitation of high intensity discharge lamps supplied with alternating current of frequencies over 1 kHz, using solutions from the state of art. Said phenomenon destabilises discharge arc, causing lamp blinking and in extreme cases, even the mechanical damage of the lamp burner. In known systems based on HALF or FULL BRIDGE and BALLAST topologies, this phenomenon is eliminated or limited by means of complex modulation methods, both frequency based FM and amplitude based AM. Surprisingly, using the system according to FIG. 1 (and also the preferred versions of FIG. 2 and FIG. 3), which in relation to the state of art includes the additional inductance L2 separating the lamp from the resonant condenser C2, the elimination of said adverse phenomenon is achieved using relatively simple techniques of frequency modulation. In the disclosed method, the control unit CONTROL2 is used, as indicated in FIG. 1, comprising the generator 2 (a generator of constant frequency and variable filling factor), which controls the signal generator CONTROL1 having included the generator 1, and next controls the cascade of electronic keys T1 and T2 in such way that the frequency voltage course on the cascade keys T1 and T2 output corresponds to the frequency of generator 1 (a generator of variable frequency and constant filling factor, with current or voltage control). The generator 1 is controlled from the output of generator of constant frequency and variable filling factor PWM, such as PWM1 and/or PWM2, what is depicted in FIG. 8, included in the control unit CONTROL2.

Figure 8:
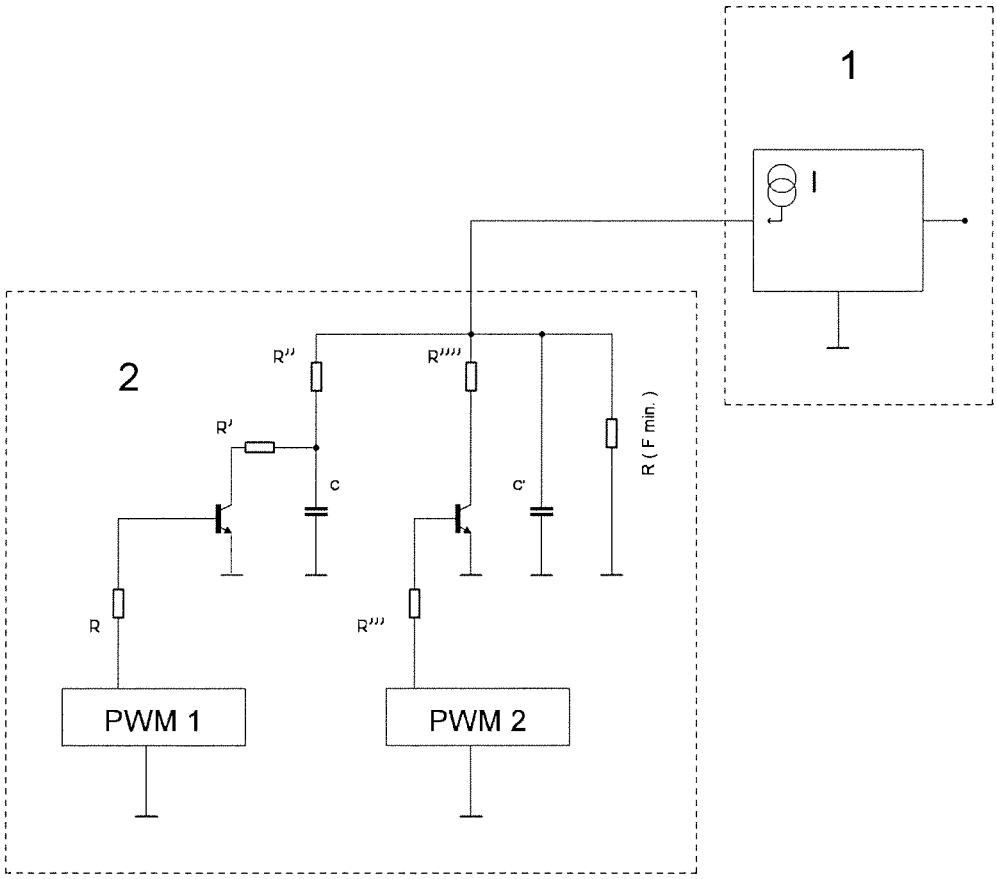
FIG. 8 is an example circuit diagram of a control unit connected with a signal generator.

FIG. 8 presents the generator 1, which is the current controlled generator of constant filling factor and variable frequency and the generator 2 having included the unit of PWM generators, where PWM I represents first PWM generator and PWM2 represents second PWM generator, R($F_{min}$) represents the resistor determining the lowest frequency of generator 1, and elements R', R", R", R"', R"", C, C' represent passive resistant-capacitive elements.

Figure 6:
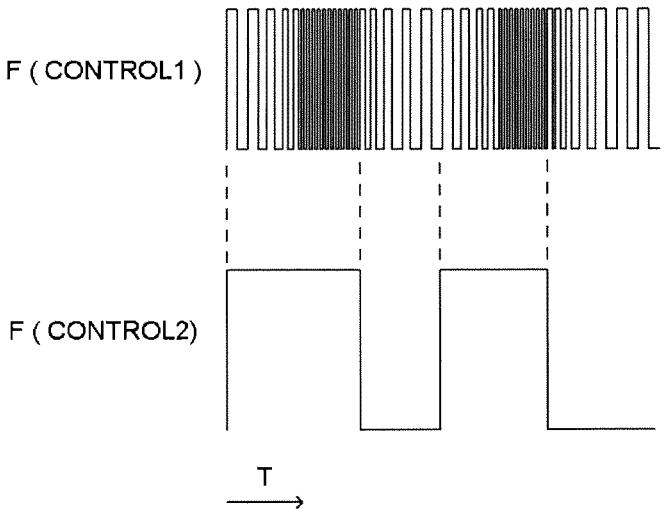
FIG. 6 is an example timing diagram showing voltage run on a control unit output and on a signal generator output.
Figure 7:
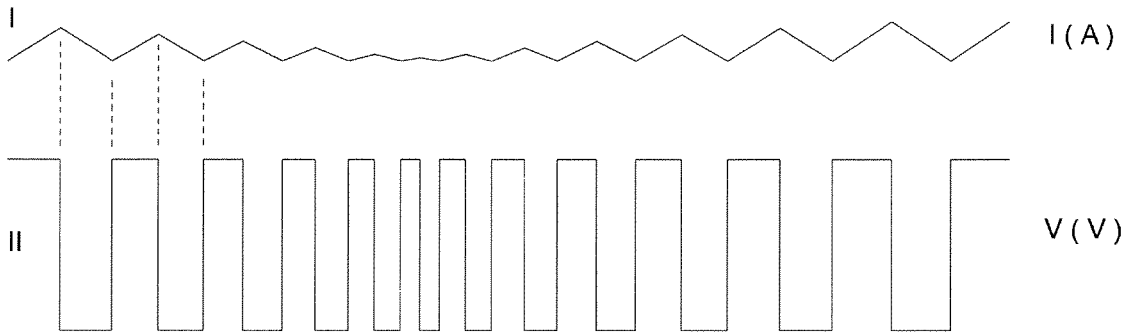
FIG. 7 is an example chart showing current running through a lamp versus a signal generator output frequency.

In conducted experiments, as the signal generator CONTROL 1 and the cascade of T1 and T2 keys the integrated electronic system FSFR2100 supplied by Fairchild company was used, having included the current controlled generator of variable frequency, the controller of unipolar transistors cascade and the cascade of said transistors. FIG. 6 presents the principle of frequency controlling of signal generator CONTROL1 by the PWM generator PWM2 output. The frequency F(CONTROL1) of signal generator CONTROL I increases when the state of output of PWM generator PWM2 is high (what is shown as F(CONTROL2)—on the output of control system CONTROL2), and decreases when said state of output is low, said changes being constant but not necessarily linear. FIG. 8 presents the exemplary system realizing the nonlinear function of frequency changes of signal generator CONTROL1 by the changes of PWM generator PWM2 state. In the system there are used bipolar transistors and elements R, R', R", R", R", R"', C, C', so that the high state on the PWM generator PWM2 output corresponds to increasing of the signal generator CONTROL1 frequency, and the low state corresponds to decreasing of this frequency. Changes of the frequencies in the system results in the changes of current values running through the lamp LAMP. This relation is depicted in FIG. 7, according to which the curve II represents the voltage course V(V) on the output of switches T1 and T2 cascade, and the curve I represents the course of current values changes I(A) running through the lamp LAMP, corresponding to these changes. As it is shown in 7, the lower frequency the higher current and power delivered to the lamp, and the higher frequency the lower current and power delivered to the lamp. On the basis of experiments conducted with use of the system, it has appeared that the stable operation of sodium discharge lamps of power ranging from 70 to 400 W is achievable by the frequency modulation of voltage course of frequencies ranging from 30 to 100 kHz being supplying the serial line of: condenser C 1, inductance L I, lamp LAMP, inductance L2, with the frequency of about 240 Hz at the modulation depth equal to 10% being a quotient of absolute value of difference between the highest or lowest frequency (Fran.,$_{Fmin}$ according to FIG. 9) and their arithmetic mean to this mean. The depth of modulation is expressed in percents. In practice, the depth of modulation can be expressed by the following equation:

$$\text{the depth of modulation} = \frac{F_{max.} - F_{min.}}{F_{max.} + F_{min.}} \times 100\%$$

In order to achieve the stable operation of metal halide lamps of power ranging from 70 to 400 W, the frequency of the voltage course supplying the serial line of: condenser C 1, inductance LI, lamp LAMP, inductance L2, which ranges from 100 to 200 kHz, is modulated with the course of frequency of about 240 Hz at modulation depth of 10%.

Figure 9:
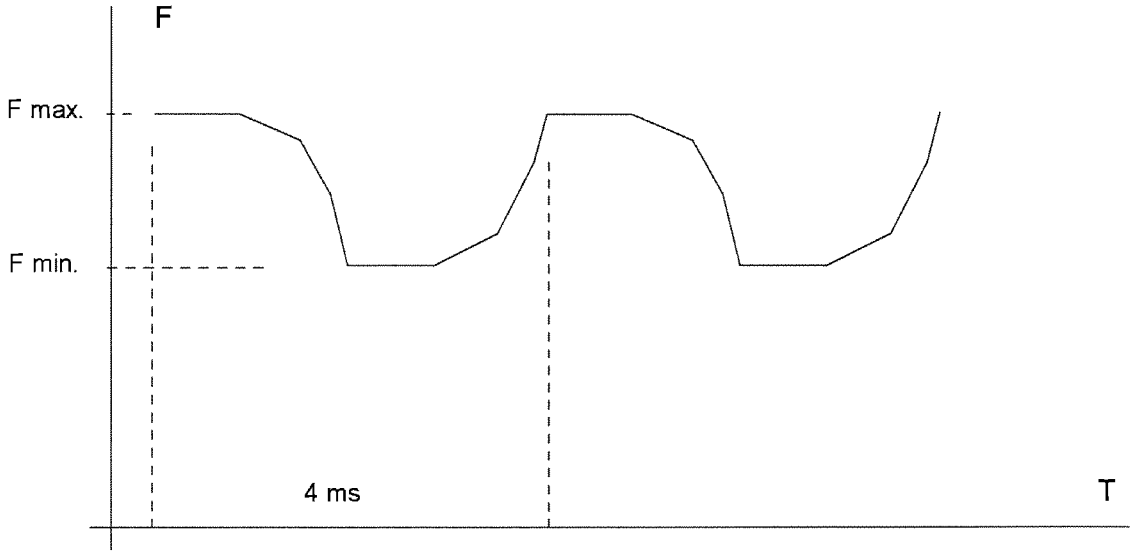
FIG. 9 is an example chart showing frequency changes when a sodium lamp is installed in the system.
Figure 10:
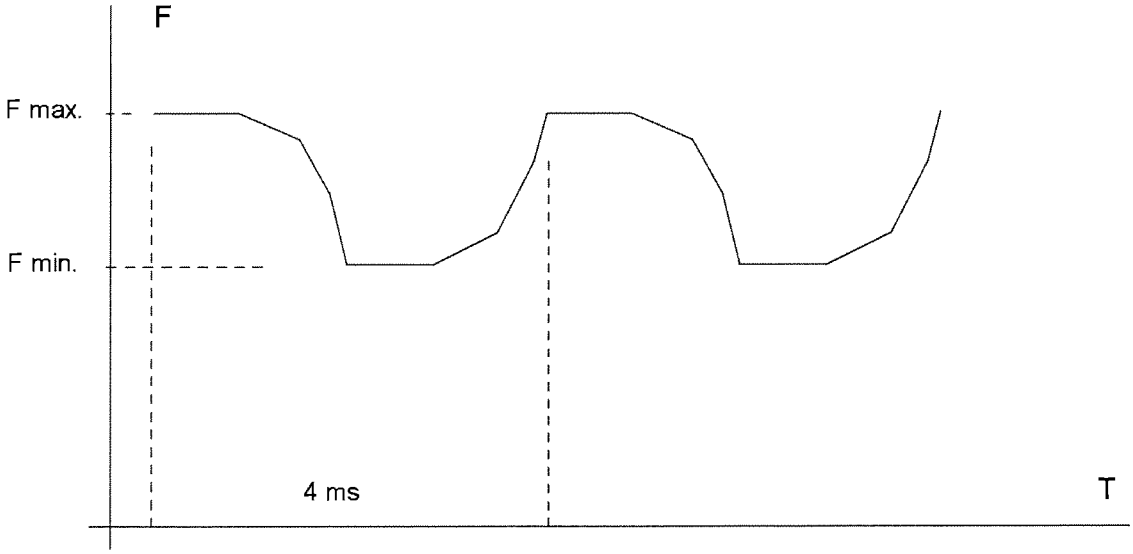
FIG. 10 is an example chart showing frequency changes when a metal halide lamp is installed in the system.

The chart of changes of frequency in the system, said changes enabling the achievement of stable operation of sodium lamps, is presented in FIG. 9, and the chart for metal halide lamps is presented in FIG. 10 (where F represents the frequency axis, T—the time axis, $F_{rmax.}$—the maximal frequency of voltage course supplying the limb CI, LI, LAMP, C2, and $F_{rmin.}$—the minimal frequency of voltage course supplying the limb CI, LI, LAMP, C2). The exemplary values of parameters of elements of system and the parameters as in the chart according to FIG. 10, in the case when the lamp LAMP is the sodium lamp, are as follows: condenser C1 47 nF, inductance L1 600 μH, condenser C2 1,175 nF, inductance L2 251.1, H, Fmax. 60 kHz, $F_{rmin.}$ 46 kHz, lamp power—100 W, and the voltage value from the PFC unit amounts to 390 V. The exemplary values of parameters of the system and the parameters as in the chart according to FIG. 10, in the case when the lamp LAMP is the metal halogen lamp, are as follows: condenser CI 47 nF, inductance LI 200 uH, condenser C2 550 pF, inductance L2 25 Fn. 140 kHz, $F_{rmin.}$ 120 kHz, lamp power 100 W, and the voltage value from the PFC unit amounted to 390 V.

As the PFC unit output voltage has the constant mean value, being independent from the load, the current consumed from this unit can be used for the measurement and the control of power consumed by the lamp LAMP.

Figure 11:
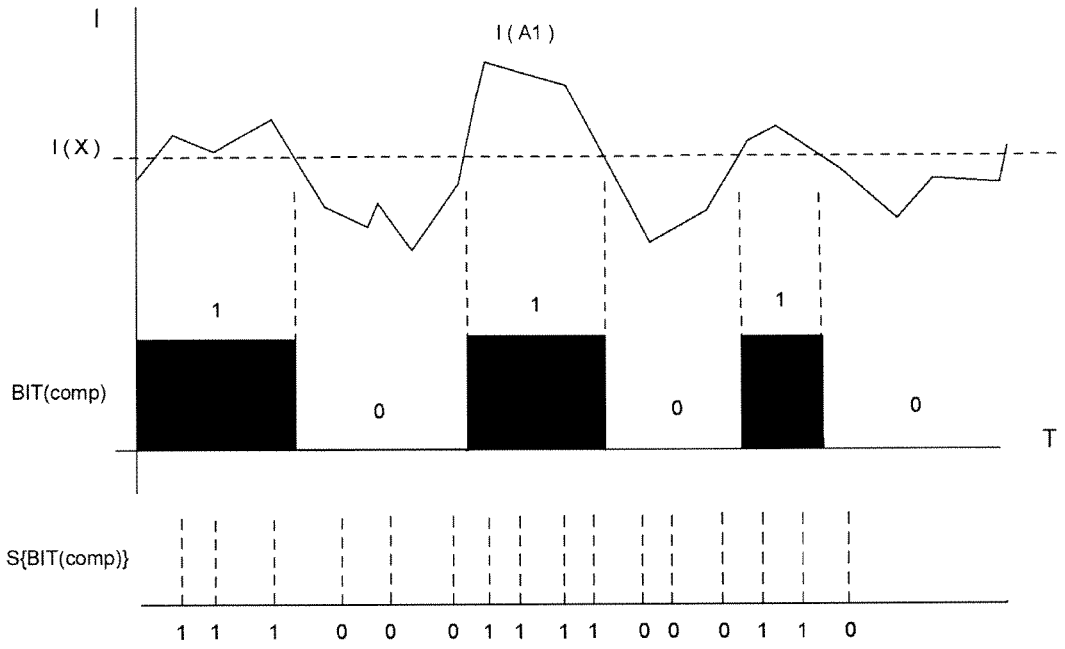
FIG. 11 is an example timing diagram showing changes of current consumed by a lamp supplying system, corresponding output states of a comparator and values of asynchronous samples of these states.

FIG. 2 presents the system according to FIG. 1, supplemented by the current measuring element AI and equipped with the comparators unit 3 having at least one comparator (being a part of the control unit CONTROL2), connected to the results output of the measuring element AI. Such arrangement of the system enables the execution of automatic control function of the power consumed by the lamp LAMP. The exemplary chart of changes of current values consumed by the lamp LAMP and the corresponding states of comparator output is presented in FIG. 11, where I(X) means the set value of current, with which the momentary value of current consumed by the lamp LAMP is compared, said current value being measured with the measuring element AI, whereas I(A1) is the current value measured with the measuring element AI. The momentary current value depends on the frequency supplying the ballast (BALLAST) and the lamp LAMP (what is presented in FIG. 7). When the highest value of variability range of current is lower from the set current value I(X), the state of comparator output from the comparator unit 3 is low [BIT(comp)=0]. When the lowest value of this range is higher than I(X), the state of comparator output from the comparator unit 3 is high [BIT(comp)=1]. When the I(X) value is within the variability range, said course is the fast-changing square waveform (change of bits 0-1). Preferably, in order to maintain the high precision of system regulation of consumed power in the system, the values of I(X) are selected in such manner that the values I(X) were within the variability range of measured current. In the analogous system of automatic power regulation, the fast-changing square voltage course on the comparator output in the comparators unit 3 can be averaged by the integrating inertial system R-C,• achieving slow-changing voltage corresponding to the mean current values and the power consumed by the lamp LAMP.

Figure 12:
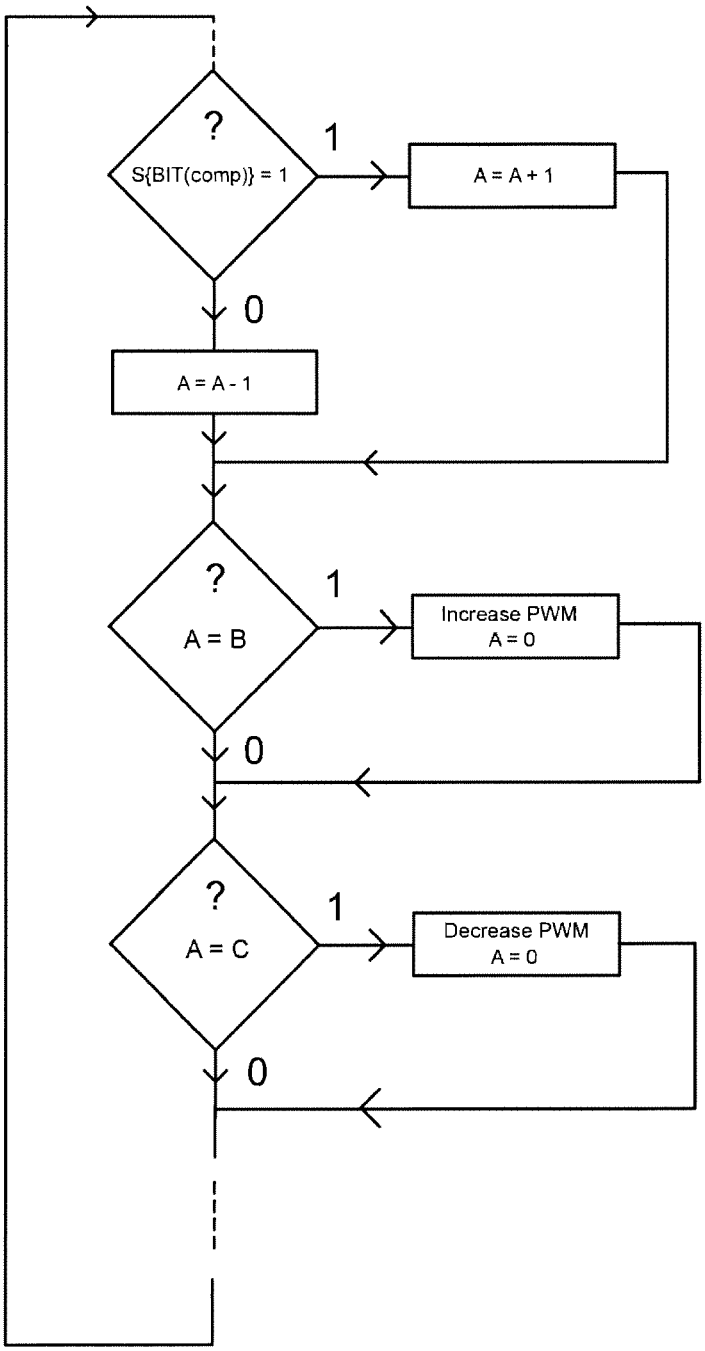
FIG. 12 is an example flowchart showing a process for digital power regulation.

This voltage can directly modulate the filling factor of PWM course of generator 2 in the control unit CONTROL2. The relation achieved in such way, which decreases the ratio of time of decreasing to increasing frequency, i.e. limiting the power supplied to the lamp depending on the average voltage value on the comparator 3 output, stabilises this power on the set level with accuracy not worse than 1%. In the microchip systems, sampling of the comparator output state S {BIT (comp)}, in the comparators unit 3, with the frequency not lower than several kilohertz, as in FIG. 11, using the exemplary simple algorithm, such as represented in FIG. 12, enables to achieve the regulation precision better than 1%. Functioning of the exemplary algorithm consists in increasing or decreasing the auxiliary variable A, depending on the state of the bit S{BIT(comp)}. After achieving the set value, positive B or negative C, the proper decreasing or increasing filling factor for the generator 2 of control unit CONTROL2 takes place, and the value of variable A is zeroed. Changing the values of B and C can change the stabilised value of power consumed by the lamp LAMP. The system is equipped with the resistor of 2.2 ohms (serving as the current measuring element), the analogue comparator LM393 and the microcontroller ATMEGA8 supplied by the company ATMEL (functioning as the PWM2 generator).

In such a system, the achieved level of precision of consumed power stabilisation is better than 1% and the power stabilisation depends only on the measuring resistor AI parameter stability.

FIG. 3 presents the system according to FIG. 2, supplemented by the additional current measuring elements A2, A3. The system embodiment of FIG. 3 enables the easy implementation of additional preferred functions of the controlling-ignition system. The current measuring element A2 can serve for monitoring of the current values running through the ignition resonant circuit, and in the exemplary embodiment, it is the measuring resistor of 0.1 ohm connected to the input of overload detection of microchip FSFR2100 and protects this circuit from too excessive current and from damage. The current measuring element A3 can serve for detecting the presence of lamp LAMP and the proper lamp ignition. The lack of current being running through the element A3 is equal to the lack of current being running through the lamp LAMP, thus being equal to the lack of lamp or its damage making the proper ignition impossible. In the exemplary system, the measuring element A3 is the measuring resistor of 0.5 ohm, and the value of current running through this resistor being measured by the voltage drop on this resistor, after comparing with the value set in the comparators unit 3, leads to the change of state on the control input of microcontroller ATMEGA8 of control unit CONTROL2.

The exemplary preferred use of the measuring element A3 in cooperation with the microcontroller, comprises decreasing of the power supplied to the lamp in the case of light fading detection, what enables for the operation of worn lamps, which cannot properly operate at the rated power level.

In summary, persons of ordinary skill in the art will readily appreciate that methods and apparatus for controlling a high intensity discharge lamp and a power supply system for the high intensity discharge lamp been provided. The foregoing description has been presented for the purposes of illustration and description. It is not intended to be exhaustive or to limit the invention to the exemplary embodiments disclosed. Many modifications and variations are possible in light of the above teachings. It is intended that the scope of the invention be limited not by this detailed description of examples, but rather by the claims appended hereto.

What is claimed is:

1. A method for controlling a high intensity discharge lamp, the method comprising:

supplying a signal of periodically fluctuating frequency and constant filling factor of 50% supplied from an electronic switches cascade of a half-bridge type that is connected with a ballast circuit, wherein the ballast circuit includes at least a first condenser, a lamp, a first inductance, and a second condenser forming a resonant circuit, wherein during an ignition mode of the lamp, the supplied signal is an exciting signal that periodically fluctuates between a first frequency $F_{min}$ and a second frequency $F_{max}$ and ignites the lamp, the second frequency $F_{max}$ being higher than the first frequency $F_{min}$ and lower than a third frequency $F_{stat}$, the third frequency $F_{stat}$ being lower than a resonant frequency $F_{res}$ of the resonant circuit, and wherein a voltage having a constant frequency $F_{stat}$ generated on the second condenser would be sufficient to ignite the lamp.

2. The method of claim 1, wherein the signal of periodically fluctuating frequency and constant filling factor of 50% is obtained from a signal generator by controlling a square signal of constant frequency and variable filling factor being generated by a control unit.

3. The method of claim 1, wherein the ballast circuit includes a second inductance in series with the lamp and separating the lamp from the second condenser.

4. The method of claim 3, wherein between a stabilized voltage source and the electronic switches cascade, a first value of a supply current is measured, and on the basis of the first value obtained, a second value of current between the second condenser and ground is determined and a third value of current between the second inductance and ground is determined.

5. The method of claim 1, wherein in the ignition mode, during supplying the signal of periodically fluctuating frequency, a first current value is measured between the second condenser and ground, and a second current value is set to a set value in a comparators unit, such that when the first current value exceeds the set value, signal supplying is stopped.

6. The method of claim 3, wherein in the ignition mode, during supplying the signal of periodically fluctuating frequency, a first current value is measured between the second inductance and ground, and a second current value is set to a set value in a comparators unit, such that when the first current value exceeds the set value, the exciting signal supplying and the ignition mode are stopped and signal delivery in a lamp supply mode is started.

7. The method of claim 1, wherein in a supply mode of the high intensity discharge lamp, the frequency of the supplied signal is modulated in cycles and smoothly from a lowest value $F_{min}$ to a highest value $F_{max}$.

8. The method of claim 7, wherein regulation of power supplied to the lamp is performed using frequency changes by changes of a filling factor of a controlling signal, in which the frequency increases when the controlling signal is high and decreases when the controlling signal is low.

9. The method of claim 1, wherein the high intensity discharge lamp is a sodium lamp.

10. The method of claim 8, wherein during the frequency changes, at least one modulating frequency is used and a depth of modulation does not exceed 15%, and the ratio of the time period in which the frequency is increasing to the time period in which the frequency is decreasing ranges from 0.1 to 10.

11. The method of claim 10, wherein a frequency modulated by the modulating frequency is 50 kHz, the modulating frequency is 240 Hz, and the depth of modulation is 10%.

12. The method of claim 1, wherein the high intensity discharge lamp is a metal halide lamp.

13. The method of claim 8, wherein during the frequency changes, at least one modulating frequency is used and a depth of modulation does not exceed 20%, and the ratio of the time period in which the frequency is increasing to the time period in which the frequency is decreasing ranges from 0.1 to 10.

14. The method of claim 13, wherein a frequency modulated by the modulating frequency is 130 kHz, the modulating frequency is 240 Hz, and the depth of modulation is 10%.

15. The method of claim 7, wherein power supplied to the lamp is regulated by changing a power pulse width in a control unit.

16. The method of claim 15, wherein the change of power pulse width in the control unit is performed using microchip control.

17. The method of claim 3, wherein a discharge arc decay is detected on a basis of current value between the second inductance and ground, when said current value is lower than a current value set on a comparator in a comparators unit for proper lamp operation, and then the lamp ignition mode is resumed.

18. The method of claim 3, wherein a lack of lamp or lamp damage making lamp operation impossible is detected on a basis of a current value between the second inductance and ground, when said current value differs from a value set on a comparator in a comparators unit for proper lamp ignition, after an ignition attempt performed after a time period that is necessary for lamp cooling.

19. The method of claim 17, wherein after detecting the discharge arc decay and resuming lamp ignition, the power value being delivered to the lamp is decreased and if the arc is not decaying, said power value is sustained, and in the case of arc decay, the ignition mode is resumed and the procedure of decreasing power is retried.

20. A supply system for a high intensity discharge lamp comprising:

a stabilized voltage source;

an electronic switches cascade electrically supplied by the stabilized voltage source, wherein the electronic switches cascade is one of a half bridge type and a full bridge type;

a lamp electrically connected to the electronic switches cascade;

a ballast electrically connected to the electronic switches cascade, the ballast including a first condenser, a first inductance, a second condenser, and a second inductance separating the lamp from the second condenser;

a signal generator electrically connected to the electronic switches cascade, the signal generator generating a signal, the signal being one of a voltage regulated frequency and a current regulated frequency, the signal having a constant filling factor, wherein during an ignition mode of the lamp, the generated signal periodically fluctuates between a first frequency $F_{min}$ and a second frequency $F_{max}$ and ignites the lamp, the second frequency $F_{max}$ being higher than the first frequency $F_{min}$ and lower than a third frequency $F_{stat}$, the third frequency $F_{stat}$ being lower than a resonant frequency $F_{res}$ of the ballast, and wherein a voltage having a constant frequency $F_{stat}$ generated on the second condenser would be sufficient to ignite the lamp; and a generator control unit electrically connected to the signal generator, the generator control unit generating modulated width impulses that change the signal generator operating frequency.

21. The system according to claim 20, wherein the first condenser and the first inductance are on an input terminal of the lamp, and the second condenser is connected in parallel to the lamp, where the first inductance and the second condenser are arranged in series to each other and form a part of a resonant circuit.

22. The system according to claim 20, wherein a voltage signal generated on an output of the electronic switches cascade is square and has a filling factor of 50%.

23. The system according to claim 21, including a measuring element between a stabilized voltage source (PFC) and the electronic switches cascade for measurement of supplying current values.

24. The system according to claim 21, including a measuring element for measurement of current running through the resonant circuit having included the first inductance and the second condenser.

25. The system according to claim 20, including a measuring element for measurement of current running through the lamp.

26. The system according to claim 23, wherein the measuring element is a resistive measuring unit.

27. The system according to claim 23, wherein the measuring element is an inductive measuring unit.

28. The system according to claim 20, wherein the generator control unit includes a generator and a comparators unit that controls the generator.

29. The system according to claim 28, wherein the generator is a microchip having an output that is controlled by the comparators unit.

30. The system according to claim 20, wherein the high intensity discharge lamp is a sodium lamp.

31. The system according to claim 20, wherein the high intensity discharge lamp is a metal halide lamp.

32. The system according to claim 24, wherein the measuring element is a resistive measuring unit.

33. The system according to claim 25, wherein the measuring element is a resistive measuring unit.

34. The system according to claim 24, wherein the measuring element is an inductive measuring unit.

35. The system according to claim 25, wherein the measuring element is an inductive measuring unit.

36. The system according to claim 20, wherein the second inductance is in series with the lamp.

* * * * *